US010345011B2

(12) United States Patent
Liang et al.

(10) Patent No.: US 10,345,011 B2
(45) Date of Patent: Jul. 9, 2019

(54) REFRIGERATION DEVICE

(71) Applicant: GREE ELECTRIC APPLIANCES, INC. OF ZHUHAI, Zhuhai, Guangdong (CN)

(72) Inventors: Xiangfei Liang, Guangdong (CN); Hui Huang, Guangdong (CN); Bo Zheng, Guangdong (CN); Jinsheng Fang, Guangdong (CN); Boliang Huang, Guangdong (CN); Rong Zhuang, Guangdong (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 74 days.

(21) Appl. No.: 15/304,448

(22) PCT Filed: Dec. 2, 2014

(86) PCT No.: PCT/CN2014/092798

§ 371 (c)(1),
(2) Date: Oct. 14, 2016

(87) PCT Pub. No.: WO2015/158138

PCT Pub. Date: Oct. 22, 2015

(65) Prior Publication Data

US 2017/0038099 A1 Feb. 9, 2017

(30) Foreign Application Priority Data

Apr. 15, 2014 (CN) ..... 2014 1 0150932

(51) Int. Cl.
*F25B 39/02* (2006.01)
*F25B 1/10* (2006.01)
(Continued)

(52) U.S. Cl.
CPC ..... *F25B 1/10* (2013.01); *F25B 30/02* (2013.01); *F25B 41/04* (2013.01); *F25B 13/00* (2013.01);
(Continued)

(58) Field of Classification Search
CPC ..... F25B 39/02; F25B 13/00; F25B 39/022; F25B 1/10; F25B 1/04; F25B 2400/075;
(Continued)

(56) References Cited

U.S. PATENT DOCUMENTS 3,905,202 A * 9/1975 Taft ..... F25B 1/00 62/152
5,092,134 A * 3/1992 Tagashira ..... F25B 1/00 62/155

(Continued)

FOREIGN PATENT DOCUMENTS

CN 101487470 A 7/2009
CN 203203289 U 9/2013

(Continued)

*Primary Examiner* — Melvin Jones
(74) *Attorney, Agent, or Firm* — Novick, Kim & Lee, PLLC; Sang Ho Lee; Zhi Yang Xue

(57) ABSTRACT

The invention discloses a refrigeration device, including: a first compressor unit (101), an indoor heat exchanger (3) and an outdoor heat exchanger (2), sequentially communicated; a first throttle device (401) and a second throttle device (402), sequentially connected in series; and an air supply device (5), provided between the first throttle device (401) and the second throttle device (402). The refrigeration device further includes a second compressor unit (102). An air intake port (B) of the second compressor unit (102) is communicated with an outlet of the outdoor heat exchanger (2). An outlet (E) of the second compressor unit (102) is communicated with the air supply port (C) of the first compressor unit (101) and an air exhaust port (D) of the first compressor unit (101) by means of a three-way valve (10), respectively.

12 Claims, 5 Drawing Sheets

(51) Int. Cl.
*F25B 30/02* (2006.01)
*F25B 41/04* (2006.01)
*F25B 13/00* (2006.01)

(52) U.S. Cl.
CPC ..... *F25B 2313/0233* (2013.01); *F25B 2341/0662* (2013.01); *F25B 2400/074* (2013.01); *F25B 2400/075* (2013.01); *F25B 2400/13* (2013.01); *F25B 2400/23* (2013.01); *F25B 2500/31* (2013.01)

(58) Field of Classification Search
CPC .... F25B 2341/0662; F25B 2313/02731; F25B 2400/13; F25B 2400/23
USPC ..... 62/515, 513, 512, 324.1, 238.6, 238.7, 62/160
See application file for complete search history.

(56) References Cited

U.S. PATENT DOCUMENTS 6,584,785 B1 * 7/2003 Karl ..... B60H 1/00314 62/117
6,708,510 B2 * 3/2004 Sulc ..... B60H 1/00907 62/151
2008/0236179 A1 * 10/2008 Ignatiev ..... F25B 1/10 62/190
2010/0282434 A1 * 11/2010 Yabuuchi ..... F24D 11/0235 165/63
2011/0100035 A1 * 5/2011 Taras ..... F24F 3/153 62/90
2011/0314848 A1 * 12/2011 Tanaka ..... F25B 13/00 62/126
2012/0073318 A1 * 3/2012 Lifson ..... F25B 1/10 62/115
2013/0104582 A1 * 5/2013 Sandkoetter ..... F25B 1/10 62/196.3

FOREIGN PATENT DOCUMENTS

CN 103954064 A 7/2014
CN 203798005 U 8/2014
DE 102010026648 A1 1/2012
EP 1757874 A2 2/2007
EP 2088388 A1 8/2009
WO 2006/118573 A1 11/2006
WO 2011/049767 A2 4/2011

* cited by examiner

REFRIGERATION DEVICE

TECHNICAL FIELD OF THE INVENTION

The invention relates to the field of air conditioners, and in particular to a refrigeration device.

BACKGROUND OF THE INVENTION

The heating capability of an air source heat pump rapidly attenuates due to temperature reduction of an outdoor environment, and cannot meet user demands accordingly. A double-stage or quasi-double-stage compression intermediate air-supplying and enthalpy-enhancing technology, including two-stage throttling incomplete inter-cooling and one-stage throttling incomplete inter-cooling circulation, is adopted in the prior art, which may improve the low-temperature heating capacity and the COP, provides some help for reduction of the exhaust temperature of a compressor, and cannot meet actual application in cold regions. However, the prior art is limited in amplitude of improvement of the heating capacity and the COP, and is also limited in reduction of the exhaust temperature of the compressor. In addition, an air-supplying and enthalpy-enhancing proportion in the prior art is restricted by a displacement ratio of a high pressure stage to a low pressure stage, and application to a heat pump type air conditioner results in design incompatibility of capability and energy efficiency.

SUMMARY OF THE INVENTION

The invention is intended to provide a refrigeration device, so as to solve the technical problem of energy efficiency or low capability of a conventional refrigeration device under an ultralow temperature condition.

To this end, the invention provides a refrigeration device, which comprises: a first compressor unit, an indoor heat exchanger and an outdoor heat exchanger, sequentially communicated, an outlet of the first compressor unit is communicated with an inlet of the indoor heat exchanger, an outlet of the indoor heat exchanger is communicated with an inlet of the outdoor heat exchanger, an outlet of the outdoor heat exchanger being connected with an air intake port of the first compressor unit, and the first compressor unit comprising two compression chambers connected in series; a first throttle device and a second throttle device, sequentially connected in series and provided between the outlet of the indoor heat exchanger and the inlet of the outdoor heat exchanger; and an air supply device, provided between the first throttle device and the second throttle device, an inlet of the air supply device is communicated with the first throttle device, a first outlet of the air supply device is communicated with an air supply port of the first compressor unit, and a second outlet of the air supply device is communicated with the second throttle device. The refrigeration device further comprises a second compressor unit. An air intake port of the second compressor unit is communicated with the outlet of the outdoor heat exchanger. An outlet of the second compressor unit is communicated with the air supply port of the first compressor unit and an air exhaust port of the first compressor unit by means of a three-way valve, respectively.

Furthermore, an electromagnetic valve is provided between the first outlet of the air supply device and the air supply port of the first compressor unit.

Furthermore, the refrigeration device further comprises an air-liquid separator, provided between the outlet of the outdoor heat exchanger and the air intake port of the first compressor unit, or provided between the outlet of the outdoor heat exchanger and the air intake port of the second compressor unit.

Furthermore, the air supply device is a flash tank.

Furthermore, the air supply device is an intermediate heat exchanger.

Furthermore, the intermediate heat exchanger is provided with a first refrigerant flow path and a second refrigerant flow path, inlets of the first refrigerant flow path and the second refrigerant flow path are communicated with the outlet of the indoor heat exchanger, the first throttle device is provided between the inlet of the first refrigerant flow path and the outlet of the indoor heat exchanger, the outlet of the first refrigerant flow path is communicated with the air supply port of the first compressor unit, and the outlet of the second refrigerant flow path is communicated with the inlet of the outdoor heat exchanger.

Furthermore, the refrigeration device comprises a plurality of indoor heat exchangers connected in parallel.

Furthermore, a branch of each of the indoor heat exchangers connected in parallel is provided with a throttle device.

Furthermore, the displacement of a low-pressure compression chamber of the first compressor unit is VA, and the displacement of a high-pressure compression chamber of the first compressor unit is VB; and a ratio range of VB/VA is 0.65-1.0.

Furthermore, the ratio range of VB/VA is 0.7-0.9.

Furthermore, the displacement of the low-pressure compression chamber of the first compressor unit is VA, the displacement of the high-pressure compression chamber of the first compressor unit is VB, and the displacement of an auxiliary compression chamber of the second compressor unit is VC; and a ratio range of VB/(VA+VC) is 0.2-0.9.

Furthermore, when the refrigeration device is applied to an ultralow temperature heat pump type air conditioner, the ratio range of VB/(VA+VC) is 0.4-0.7.

Furthermore, when the refrigeration device is applied to an ultralow temperature air source heat pump water heater, the ratio range of VB/(VA+VC) is 0.25-0.6.

The invention has the beneficial effects as follows.

The refrigeration device of the invention is additionally provided with an auxiliary compressor which is connected in parallel to a low-pressure compression chamber of a main compressor or connected in parallel to the main compressor. Various variable capacity modes are formed by selective switching. Application to a heat pump occasion can significantly improve an ultralow temperature heating capacity and/or a heating performance coefficient. Application to an air conditioner occasion may significantly improve a refrigeration capacity and an energy efficiency ratio. The refrigeration device is superior to a double-stage compression or quasi-double-stage compression refrigeration device, and the aim of compatibility of high energy efficiency and high capability is achieved under a wider operating condition.

In addition to the aim, features and advantages described above, the invention also has other aims, features and advantages. The invention will be further elaborated below with reference to the drawings.

BRIEF DESCRIPTION OF THE DRAWINGS

The drawings forming a part of the invention are intended to provide further understanding of the invention. The schematic embodiments and illustrations of the invention are intended to explain the invention, and do not form improper limits to the invention. In the drawings.

Figure 1:
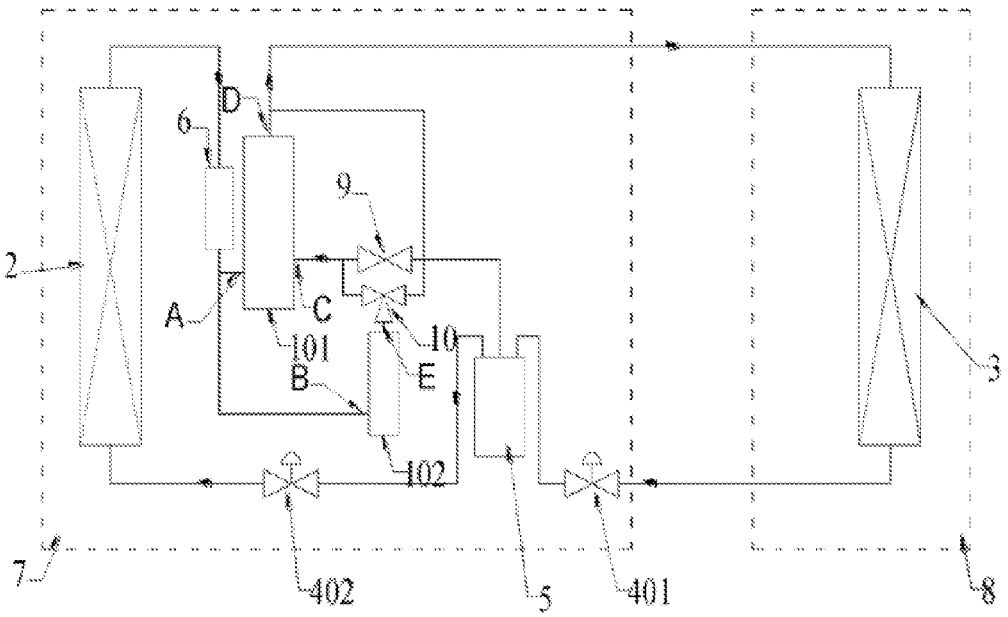
FIG. 1 is a first embodiment diagram of a refrigeration device according to the invention.

Drawing marks in the drawings are as follows. 101、a first compressor unit. 102、a second compressor unit. 2、an outdoor heat exchanger. 3、an indoor heat exchanger. 301、a first indoor heat exchanger. 302、a second indoor heat exchanger. 401、a first throttle device. 402、a second throttle device. 5、an air supply device. 6、an air-liquid separator. 7、an outdoor unit. 8、an indoor unit. 801、a first indoor unit. 802、a second indoor unit. 9、an electromagnetic valve. 10、a three-way valve.

DETAILED DESCRIPTION OF THE EMBODIMENTS

The embodiments of the invention are elaborated below in conjunction with the drawings. However, the invention may be implemented by various different modes limited and covered by the claims.

Referring to FIG. 1 to FIG. 10, a refrigeration device according to the invention comprises: a first compressor unit 101, an indoor heat exchanger 3 and an outdoor heat exchanger 2, sequentially communicated, an outlet of the first compressor unit 101 is communicated with an inlet of the indoor heat exchanger 3, an outlet of the indoor heat exchanger 3 is communicated with an inlet of the outdoor heat exchanger 2, an outlet of the outdoor heat exchanger 2 is communicated with an air intake port A of the first compressor unit 101, and the first compressor unit 101 comprising two compression chambers connected in series; a first throttle device 401 and a second throttle device 402, sequentially connected in series and provided between the outlet of the indoor heat exchanger 3 and the inlet of the outdoor heat exchanger 2; and an air supply device 5, provided between the first throttle device 401 and the second throttle device 402, an inlet of the air supply device 5 is communicated with the first throttle device 401, a first outlet of the air supply device 5 is communicated with an air supply port of the first compressor unit 101, and a second outlet of the air supply device 5 is communicated with the second throttle device 402. The refrigeration device further comprises a second compressor unit 102. An air intake port B of the second compressor unit 102 is communicated with the outlet of the outdoor heat exchanger 2. An outlet E of the second compressor unit 102 is communicated with the air supply port C of the first compressor unit 101 and an air exhaust port D of the first compressor unit 101 by means of a three-way valve 10, respectively. An indoor unit 8 comprises relevant parts such as the indoor heat exchanger 3. An outdoor unit 7 comprises relevant parts such as a compressor 1, the outdoor heat exchanger 2 and an air-liquid separator 6.

Figure 2:
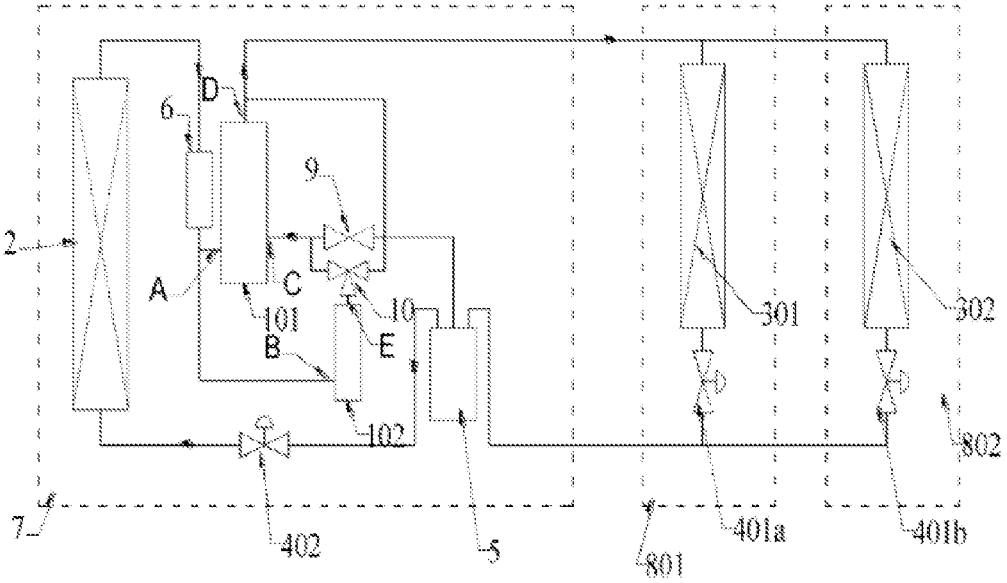
FIG. 2 is a second embodiment diagram of a refrigeration device according to the invention.
Figure 3:
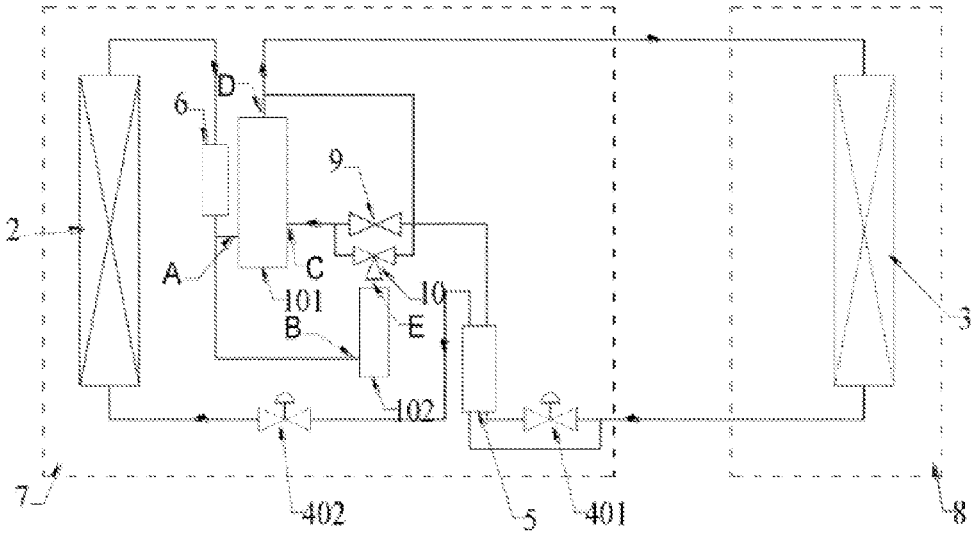
FIG. 3 is a third embodiment diagram of a refrigeration device according to the invention.

Referring to FIG. 1 to FIG. 3, an electromagnetic valve 9 is provided between a first outlet of the air supply device 5 and the air supply port of the first compressor unit 101. The refrigeration device further comprises an air-liquid separator 6, provided between the outlet of the outdoor heat exchanger 2 and the air intake port of the first compressor unit 101 or the air intake port B of the second compressor unit 102. The flash tank of the refrigeration device of the invention may be a one-way flash tank or a two-way flash tank, or may be other flash tanks having air-supplying and liquid-carrying functions. The first throttle device and second throttle device of the refrigeration device of the invention may be capillary tubes, short throttle tubes, thermostatic expansion valves, electronic expansion valves, throttle orifice plates or any reasonable combination. The refrigeration device of the invention may be added with necessary parts such as a four-way reversing valve so as to adapt to application occasions of refrigeration, heating or heating water. The three-way valve and a two-way valve of the invention may be replaced with other technical solutions having equivalent switching effects.

Referring to FIG. 1 to FIG. 3, the air supply device 5 is a flash tank or an intermediate heat exchanger. When the air supply device 5 is the intermediate heat exchanger, the intermediate heat exchanger is provided with two inlets, a first inlet and second inlet of the intermediate heat exchanger are communicated with the outlet of the indoor heat exchanger 3, and the first throttle device 401 is provided between the first inlet of the intermediate heat exchanger and the outlet of the indoor heat exchanger 3.

Referring to FIG. 2, the refrigeration device comprises a plurality of indoor heat exchangers 3 connected in parallel. A branch of each of the indoor heat exchangers 3 connected in parallel is provided with a throttle device.

FIG. 1 is a system circulation solution of the invention. A corresponding compressor unit is composed of the first compressor unit (main compressor) 101 and the second compressor unit (auxiliary compressor) 102. The first compressor unit 101 is a compressor having a double-stage or quasi-two-stage compression intermediate air-supplying and enthalpy-enhancing function, a main compression chamber is formed by connecting a low-pressure compression chamber and a high-pressure compression chamber in series. The second compressor unit 102 may be a compressor, having a refrigerant air compression function, in any form, and has an auxiliary compression chamber. The auxiliary compression chamber of the second compressor unit is connected in parallel to the low-pressure compression chamber of the main compression chamber of the first compressor unit or connected in parallel to the main compression chamber of the first compressor unit. The compressor unit of the invention may have seven operating modes shown in FIG. 4 to FIG. 10 by selective switching. A specific implementation solution is as follows.

Figure 4:
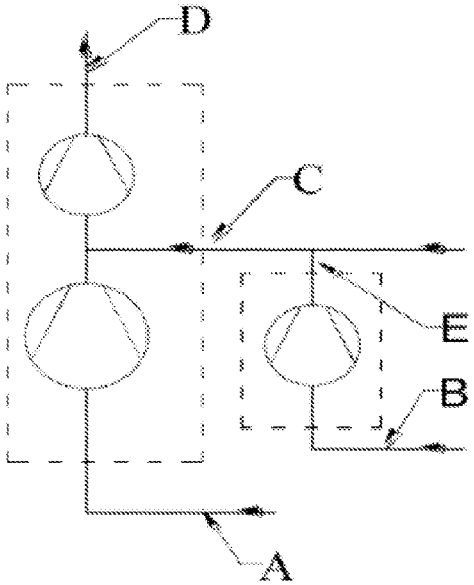
FIG. 4 is a first operating mode diagram of a compressor unit of a refrigeration device according to the invention.

The three-way valve 10 in FIG. 1 switches and is communicated with a port C (air supply port) of the first compressor unit 101 and a port E (air exhaust port) of the second compressor unit, the electromagnetic valve 9 is kept turned on, the first compressor unit and the second compressor unit operate simultaneously, and an operating mode of capacity increasing, by parallel connection between the auxiliary compression chamber of the second compressor unit 102 shown in FIG. 4 and the low-pressure compression chamber of the first compressor unit 101, and double-stage compression intermediate air supply is implemented.

Figure 5:
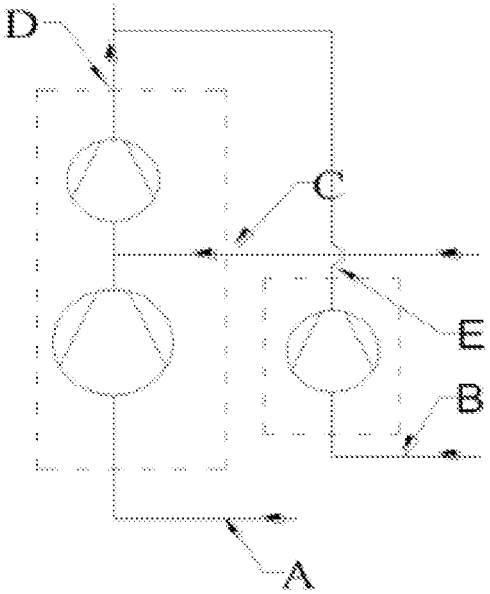
FIG. 5 is a second operating mode diagram of a compressor unit of a refrigeration device according to the invention.

The three-way valve 10 in FIG. 1 switches and is communicated with a port D (air exhaust port) of the first compressor unit 101 and the port E (air exhaust port) of the second compressor unit, the electromagnetic valve 9 is kept turned on, the first compressor unit and the second compressor unit operate simultaneously, and an operating mode of capacity increasing, by parallel connection between the auxiliary compression chamber of the second compressor unit 102 shown in FIG. 5 and the main compression chamber of the first compressor unit 101, and double-stage compression intermediate air supply of the main compression chamber is implemented.

Figure 6:
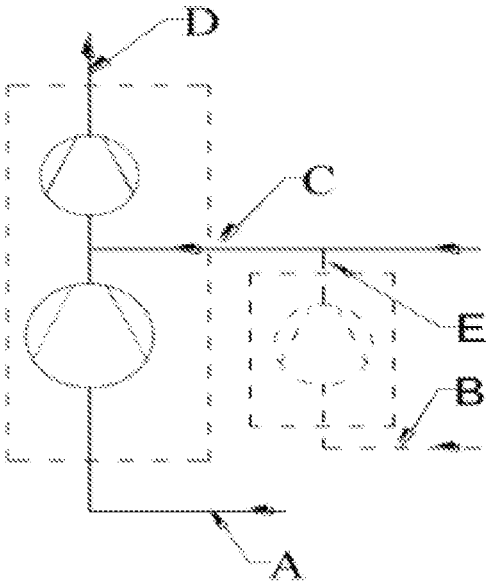
FIG. 6 is a third operating mode diagram of a compressor unit of a refrigeration device according to the invention.

The three-way valve 10 in FIG. 1 switches and is communicated with the port C (air supply port) or port D (air exhaust port) of the first compressor unit 101 and the port E (air exhaust port) of the second compressor unit, the electromagnetic valve 9 is kept turned on, the first compressor unit operates, the second compressor unit stops operating, and an operating mode of double-stage compression intermediate air supply of the main compression chamber of the first compressor unit shown in FIG. 6 is formed.

Figure 7:
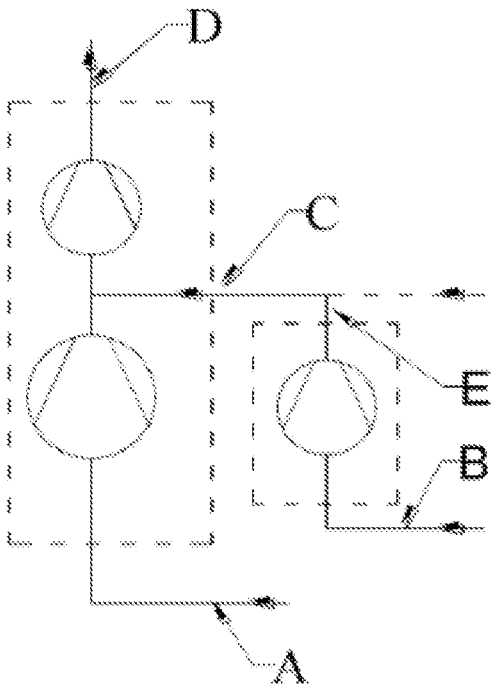
FIG. 7 is a fourth operating mode diagram of a compressor unit of a refrigeration device according to the invention.

The three-way valve 10 in FIG. 1 switches and is communicated with the port C (air supply port) of the first compressor unit 101 and the port E (air exhaust port) of the second compressor unit, the electromagnetic valve 9 is turned off, the first compressor unit and the second compressor unit operate simultaneously, and an operating mode of capacity increasing, by parallel connection between the auxiliary compression chamber of the second compressor unit 102 shown in FIG. 7 and the low-pressure compression chamber of the first compressor unit 101, and double-stage compression intermediate without air supply is formed.

Figure 8:
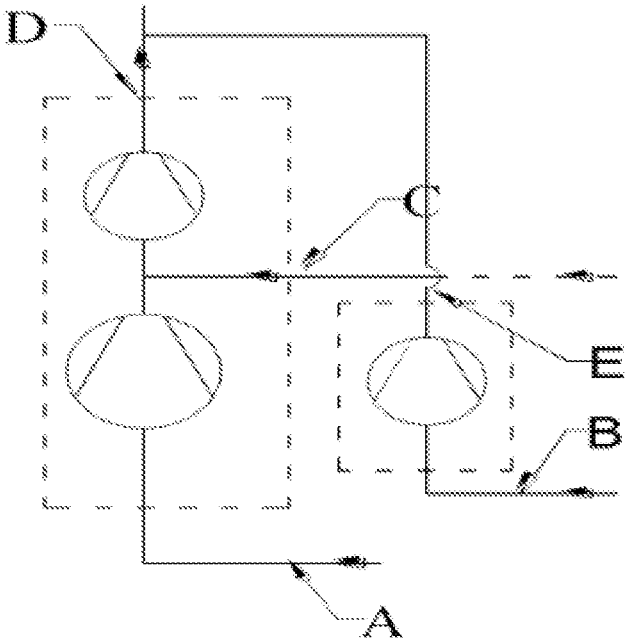
FIG. 8 is a fifth operating mode diagram of a compressor unit of a refrigeration device according to the invention.

The three-way valve 10 in FIG. 1 switches and is connected with the port D (air exhaust port) of the first compressor unit 101 and the port E (air exhaust port) of the second compressor unit, the electromagnetic valve 9 is turned off, the first compressor unit and the second compressor unit operate simultaneously, and an operating mode of capacity increasing, by parallel connection between the auxiliary compression chamber of the second compressor unit 102 shown in FIG. 8 and the main compression chamber of the first compressor unit 101, and double-stage compression intermediate without air supply of the main compression chamber is formed.

Figure 9:
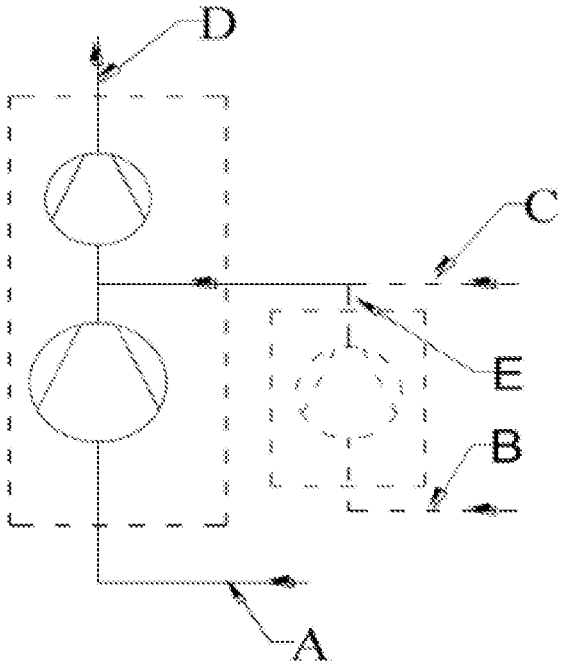
FIG. 9 is a sixth operating mode diagram of a compressor unit of a refrigeration device according to the invention.

The three-way valve 10 in FIG. 1 switches and is communicated with the port C (air supply port) or port D (air exhaust port) of the first compressor unit 101 and the port E (air exhaust port) of the second compressor unit, the electromagnetic valve 9 is turned off, the first compressor unit operates, the second compressor unit stops operating, and an operating mode of double-stage compression intermediate without air supply of the main compression chamber of the first compressor unit 101 shown in FIG. 9 is formed.

Figure 10:
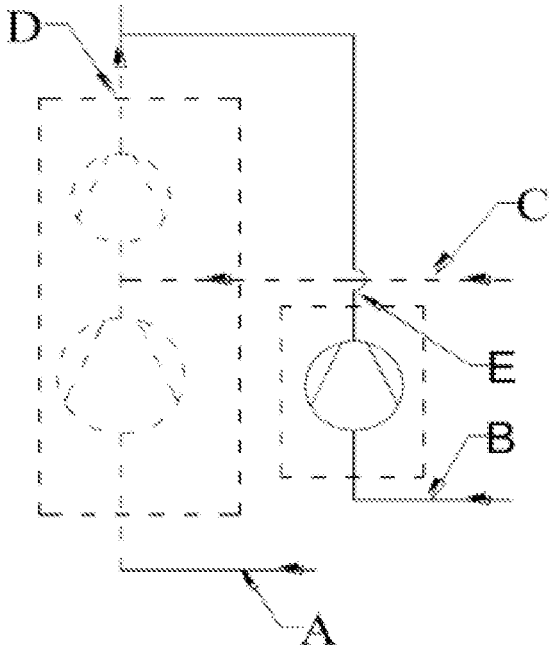
FIG. 10 is a seventh operating mode diagram of a compressor unit of a refrigeration device according to the invention.

The three-way valve 10 in FIG. 1 switches and is communicated with the port D (air exhaust port) of the first compressor unit 101 and the port E (air exhaust port) of the second compressor unit, the electromagnetic valve 9 is turned off, the first compressor unit stops operating, the second compressor unit operates, and an operating mode of single-stage compression of the auxiliary compression chamber of the second compressor unit 102 shown in FIG. 10 is formed.

A system diagram connecting relation of the invention in FIG. 1 is as follows. The air exhaust port D of the first compressor unit 101 is connected with an inlet of a condenser 3, and is connected with an inlet of the flash tank via the first throttle device 401. The flash tank is provided with an air outlet and a liquid outlet. The air outlet of the flash tank is connected with the air supply port C of the first compressor unit 101 by means of the electromagnetic valve 9. The liquid outlet of the flash tank is connected with the inlet of the outdoor heat exchanger 2 via the second throttle device 402. An outlet of an evaporator is connected with an inlet of the air-liquid separator 6 of the first compressor unit 101. An outlet of the air-liquid separator 6 is divided into two branches, a first branch is connected with an air suction port A of the first compressor unit 101, and a second branch is connected with an air suction port B of the second compressor unit 102. Two ports which are not communicated with each other in three ports of the three-way valve 10 are connected with the air exhaust port D and air supply port C of the first compressor unit 101 respectively, and the other port of the three-way valve 10, namely a common port, is connected with the air exhaust port E of the second compressor unit 102.

Seven variable capacity operating modes shown in FIG. 4 to FIG. 10 are implemented by switching between the electromagnetic valve 9 and the three-way valve 10 and start/stop of the two compressor units in FIG. 1. The capability within a wide work condition range may be regulated in conjunction with variable frequency regulation of the two compressor units. The motor efficiency of the two compressor units and the system operating efficiency of the refrigeration device may be effectively played on the premise of meeting comfort. Compared with three compression chambers of the same housing, the invention has the obvious advantages as follows. 1) The wide range regulation of a displacement ratio of a high-pressure stage to a low-pressure stage is realized by means of the frequency regulation of the two compressor units, thus more aiding in improving the COP of the refrigeration device under a variable work condition. 2) The motor efficiency of a second compressor is improved using an independent operating mode of the second compressor unit, thus improving the COP of the refrigeration device under a low-load work condition, and the quantity of refrigerants in the flash tank is regulated using the first throttle device 401 and the second throttle device 402, thus further improving the COP of the refrigeration device under the low-load work condition.

The heating capacity may be significantly improved by executing an operating mode shown in FIG. 4 or FIG. 5 during ultralow temperature heating. The circulation flow of high- and low-pressure stage refrigerants is significantly increased, thus improving the property of heat transfer in a tube. Meanwhile, due to utilization of technical effects of air supplying and enthalpy enhancing, compared with the prior art, the invention enables the COP to be improved accordingly under the same low temperature heating capacity. Under the operating mode shown in FIG. 5, when both the two compressor units operate with high frequency, the exhaust temperature of the second compressor unit will be over-high. In this case, the operating mode in FIG. 4 may be selected to reduce the exhaust temperature using an intermediate air-supplying and enthalpy-enhancing technology.

The effects of the prior art can be normally played by executing an operating mode shown in FIG. 6 during medium- and low-temperature heating. The defrosting speed may be increased by executing an operating mode shown in FIG. 7 or FIG. 8 during defrosting via a necessary four-way reversing valve under a low-temperature heating frosting work condition, thus improving the low-temperature heating effect and the comfort. An operating mode shown in FIG. 9 is executed during medium- and high-temperature heating, and the motor efficiency of the first compressor unit may be improved by reasonably designing the displacement of the first compressor unit, thus improving the COP of the refrigeration device during medium- and high-temperature heating. When an indoor temperature during high-temperature heating approaches or reaches a set temperature or a comfort temperature, an operating mode shown in FIG. 10 is executed. Compared with reduction of the motor efficiency due to over-low compressor operating frequency in the prior art, the invention improves the operating frequency of the second compressor by reasonably designing the displacement of the second compressor, thus achieving the effect of improving the operating efficiency of a motor.

Therefore, compared with the prior art, the first compressor unit, the second compressor unit and the refrigeration device with the two units of the invention have the obvious technical advantages, comprising relative improvement of the COP under a wide operating condition, significant improvement of an ultralow temperature heating capacity, elimination of an auxiliary electric heater in the case of meeting demands for heat comfort in cold regions, and fundamental solving of a potential safety hazard of an electric appliance caused by the auxiliary electric heater at the same time of great improvement of the COP.

The invention in FIG. 2 is a transformed form of the invention in FIG. 1. The difference between the invention in FIG. 2 and the invention in FIG. 1 lies in that two or more indoor units connected in parallel are shown in FIG. 2, each indoor unit comprises a condenser and a first throttle device connected in series to the downstream part of the condenser. Two compressor units of the invention in FIG. 2 are similar to those in FIG. 1. The seven operating modes shown in FIG. 4 to FIG. 10 are implemented by switching. Similar effects of the invention in FIG. 1 are provided. A connecting relation of the invention in FIG. 2 is similar to that of the invention in FIG. 1, the only difference being that the invention in FIG. 2 has a plurality of indoor units connected in parallel. For example, the invention has two indoor units, namely a first indoor unit 801 and a second indoor unit 802, and further has two indoor heat exchangers 301 and 302, as well as a first throttle device 401*a* and a second throttle device 401*b* connected in series to the indoor heat exchangers.

The invention in FIG. 3 is a transformed form of the invention in FIG. 1. The difference between the invention in FIG. 3 and the invention in FIG. 1 lies in that the flash tank in FIG. 1 is replaced with an intermediate heat exchanger in FIG. 3. The intermediate heat exchanger in FIG. 3 has two refrigerant channels. The second refrigerant channel (main flow path) is communicated with the outlet of the condenser 3 and the second throttle device 402. The first refrigerant channel (air supply path) is communicated with the air supply port C of the compressor unit and the outlet of the condenser 3. The first throttle device 401 is connected in series between the outlet of the condenser 3 and an inlet of the first refrigerant channel of the intermediate heat exchanger 5. The electromagnetic valve is connected in series between the air supply port C of the first compressor unit and an outlet of the first refrigerant channel of the intermediate heat exchanger 5. The similar technical effects of the invention in FIG. 1 may be achieved by replacing the flash tank of the invention in FIG. 1 with the intermediate heat exchanger of the invention in FIG. 3. The two compressor units of the invention in FIG. 3 and the two compressor units of the invention in FIG. 1 have seven operating modes.

The displacement of a low-pressure compression chamber of the first compressor unit of the invention is VA, the displacement of a high-pressure compression chamber of the first compressor unit is VB, and the displacement of an auxiliary compression chamber of the second compressor unit is VC. As for the refrigeration device containing refrigerants of R410A, R290 and R32 or containing a mixed refrigerant of R32 and R1234yf or containing a mixed refrigerant of R32 and R1234ze, the displacement ratios of all compression chambers of the invention are as follows. VB/VA is 0.65-1.0, and is further optimized as 0.7-0.9. VB/(VA+VC) is 0.2-0.9, is further optimized as 0.4-0.7 when the refrigeration device is applied to an ultralow temperature heat pump type air conditioner, and is further optimized as 0.25-0.6 when the refrigeration device is applied to an ultralow temperature air source heat pump water heater.

From the above description, it may be seen that the above embodiments of the invention achieve the technical effects as follows.

Application of the refrigeration device of the invention to a heat pump occasion can significantly improve an ultralow temperature heating capacity and/or a heating performance coefficient. Application to an air conditioner occasion may significantly improve a refrigeration capacity and an energy efficiency ratio. The refrigeration device is superior to a double-stage compression or quasi-double-stage compression refrigeration device, and the aim of compatibility of high energy efficiency and high capability is achieved under a wider operating condition. Meanwhile, an auxiliary electric heater may be eliminated, thus avoiding the problems of potential safety hazard of an electric appliance and reduction of the heating performance coefficient caused by an electric heating device.

The above is only the preferred embodiments of the invention, and is not intended to limit the invention. There may be various modifications and variations in the invention for those skilled in the art. Any modifications, equivalent replacements, improvements and the like within the spirit and principle of the invention shall fall within the protective scope of the invention.

The invention claimed is:

1. A refrigeration device, comprising:

a first compressor unit, an indoor heat exchanger and an outdoor heat exchanger, sequentially communicated, an outlet of the first compressor unit is communicated with an inlet of the indoor heat exchanger, an outlet of the indoor heat exchanger is communicated with an inlet of the outdoor heat exchanger, an outlet of the outdoor heat exchanger is communicated with an air intake port of the first compressor unit, and the first compressor unit comprising two compression chambers connected in series;

a first throttle device and a second throttle device, sequentially connected in series and provided between the outlet of the indoor heat exchanger and the inlet of the outdoor heat exchanger; and an air supply device, provided between the first throttle device and the second throttle device, an inlet of the air supply device is communicated with the first throttle device, a first outlet of the air supply device is communicated with an air supply port of the first compressor unit, and a second outlet of the air supply device is communicated with the second throttle device, wherein the refrigeration device further comprises a second compressor unit, an air intake port of the second compressor unit is communicated with the outlet of the outdoor heat exchanger, an outlet of the second compressor unit is communicated with the air supply port of the first compressor unit and an air exhaust port of the first compressor unit by means of a three-way valve, respectively, wherein an elecrtromagnetic valve is provided between the first outlet of the air supply device and the air supply port of the first compressor unit.

2. The refrigeration device according to claim 1, further comprising:

an air-liquid separator, provided between the outlet of the outdoor heat exchanger and the air intake port of the first compressor unit, or provided between the outlet of the outdoor heat exchanger and the air intake port of the second compressor unit.

3. The refrigeration device according to claim 1, wherein the air supply device is a flash tank.

4. The refrigeration device according to claim 1, wherein the air supply device is an intermediate heat exchanger.

5. The refrigeration device according to claim 4, wherein the intermediate heat exchanger is provided with a first refrigerant flow path and a second refrigerant flow path, inlets of the first refrigerant flow path and the second refrigerant flow path are communicated with the outlet of the indoor heat exchanger, the first throttle device is provided between the inlet of the first refrigerant flow path and the outlet of the indoor heat exchanger, the outlet of the first refrigerant flow path is communicated with the air supply port of the first compressor unit, and the outlet of the second refrigerant flow path is communicated with the inlet of the outdoor heat exchanger.

6. The refrigeration device according to claim 1, wherein the refrigeration device comprises a plurality of indoor heat exchangers connected in parallel.

7. The refrigeration device according to claim 6, wherein a branch of each of the indoor heat exchangers connected in parallel is provided with a throttle device.

8. The refrigeration device according to claim 1, wherein a displacement of a low-pressure compression chamber of the first compressor unit is VA, and a displacement of a high-pressure compression chamber of the first compressor unit is VB; and a ratio range of VB/VA is 0.65-1.0.

9. The refrigeration device according to claim 8, wherein the ratio range of VB/VA is 0.7-0.9.

10. The refrigeration device according to claim 1, wherein a displacement of a low-pressure compression chamber of the first compressor unit is VA, a displacement of a high-pressure compression chamber of the first compressor unit is VB, and the displacement of an auxiliary compression chamber of the second compressor unit is VC; and a ratio range of VB/(VA+VC) is 0.2-0.9.

11. The refrigeration device according to claim 10, wherein when the refrigeration device is applied to an ultralow temperature heat pump type air conditioner, the ratio range of VB/(VA+VC) is 0.4-0.7.

12. The refrigeration device according to claim 10, wherein when the refrigeration device is applied to an ultralow temperature air source heat pump water heater, the ratio range of VB/(VA+VC) is 0.25-0.6.

* * * * *